US007175267B2

(12) United States Patent
Lui

(10) Patent No.: US 7,175,267 B2
(45) Date of Patent: Feb. 13, 2007

(54) INK CARTRIDGE

(75) Inventor: Pui Kuong Lui, Kowloon (HK)

(73) Assignee: Monitek Electronics Limited, Kowloon (HK)

( * ) Notice: Subject to any disclaimer, the term of this patent is extended or adjusted under 35 U.S.C. 154(b) by 192 days.

(21) Appl. No.: 10/838,357

(22) Filed: May 5, 2004

(65) Prior Publication Data

US 2005/0248636 A1 Nov. 10, 2005

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS 5,425,478 A * 6/1995 Kotaki et al. ..... 222/501
5,703,633 A * 12/1997 Gehrer et al. ..... 347/86
5,764,259 A * 6/1998 Nakajima ..... 347/86
5,877,794 A * 3/1999 Takagi ..... 347/87
5,906,446 A * 5/1999 McCulloch et al. ..... 401/199
5,912,689 A * 6/1999 Otsuka et al. ..... 347/86
6,345,889 B1 * 2/2002 Sakuraoka et al. ..... 347/86
6,412,931 B1 * 7/2002 Kurata et al. ..... 347/86
6,874,874 B2 * 4/2005 Sasaki ..... 347/86

* cited by examiner

*Primary Examiner*—Anh T. N. Vo
(74) *Attorney, Agent, or Firm*—Troxell Law Office, PLLC

(57) ABSTRACT

An ink cartridge adapted for an ink jet printer includes a housing, a top cover and an ink porous member. The housing has a bottom wall, a plurality of upstanding side walls extending from edges of the bottom wall, a plurality of upstanding baffles extending from a middle of the bottom wall to define an inner chamber and an outer chamber and an ink outlet port in communication with the inner chamber for containing ink therein. The ink porous member is arranged within the inner chamber of the housing for being impregnated with the ink, and the ink is filled in the outer chamber thereby to storage with a higher quantity of ink.

9 Claims, 4 Drawing Sheets

INK CARTRIDGE

BACKGROUND OF THE INVENTION

1. Field of the Invention

The present invention relates to an ink cartridge and, more particularly to an ink cartridge having an inner chamber in which a porous member is received and an outer chamber for storage with a higher quantity of ink.

2. Description of the Related Art

Conventionally, ink-jet type recording apparatus use liquid ink to print recording data. Particularly, an ink-jet type recording apparatus employs an ink cartridge that supplies ink contained therein to the recording head. The ink cartridge is directly connected to the recording head through the use of an ink supply needle mounted on the recording head. Ink is delivered by utilizing a pressure difference between the ink in the recording head and the ink in the cartridge, and by capillary forces.

With reference to FIG. 1, the ink cartridge 1*a* for the recording head including a housing 10*a* that contains an ink porous member 11*a* is known from a commonly prior art. The ink supply needle of the recording head extends into the interior of the housing 10*a* and locally compresses the ink porous member 11*a*. It is assumed that this local compression increases the capillary forces of the ink porous member 11*a* around the ink supply needle, so that the ink content of the ink porous member 11*a* can be used more completely.

In the configuration of the ink cartridge, the ink porous member 11*a* is completely accommodated in an inner space of the ink cartridge to absorb the ink. Thus, it is demanded that the filling be done efficiently so that the ink can reach to the corners inside the porous member 11*a*. However, the ink porous member 11*a* has an outline size substantially equal to that of the inner space of the ink cartridge thereby occupying the partial space that can be filled by more ink in the ink cartridge.

Hence, an ink cartridge having an improved housing and porous member is required to overcome the disadvantages of the prior art.

SUMMARY OF THE INVENTION

It is therefore a principal object of the present invention to provide an ink cartridge for storage with a higher quantity of ink therein. Furthermore, the present invention has been accomplished to eliminate the aforesaid problem.

It is another object of the present invention to provide an ink cartridge for reducing the material used in porous member, so that the cost of manufacturing and/or recycling the cartridge can be lower.

In order to achieve the above object, an ink cartridge adapted for an ink jet printer includes a housing, a top cover and an ink porous member. The housing has a bottom wall, a plurality of upstanding side walls extending from edges of the bottom wall, a plurality of upstanding baffles extending from a middle of the bottom wall to define an inner chamber and an outer chamber and an ink outlet port in communication with the inner chamber for containing ink therein. The top cover is coupled on the housing. The ink porous member is arranged within the inner chamber of the housing for being impregnated with ink. Furthermore, at least one slot is formed between at least two abutting baffles, so that the ink in the outer chamber can freely flow into the inner chamber through the slot.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
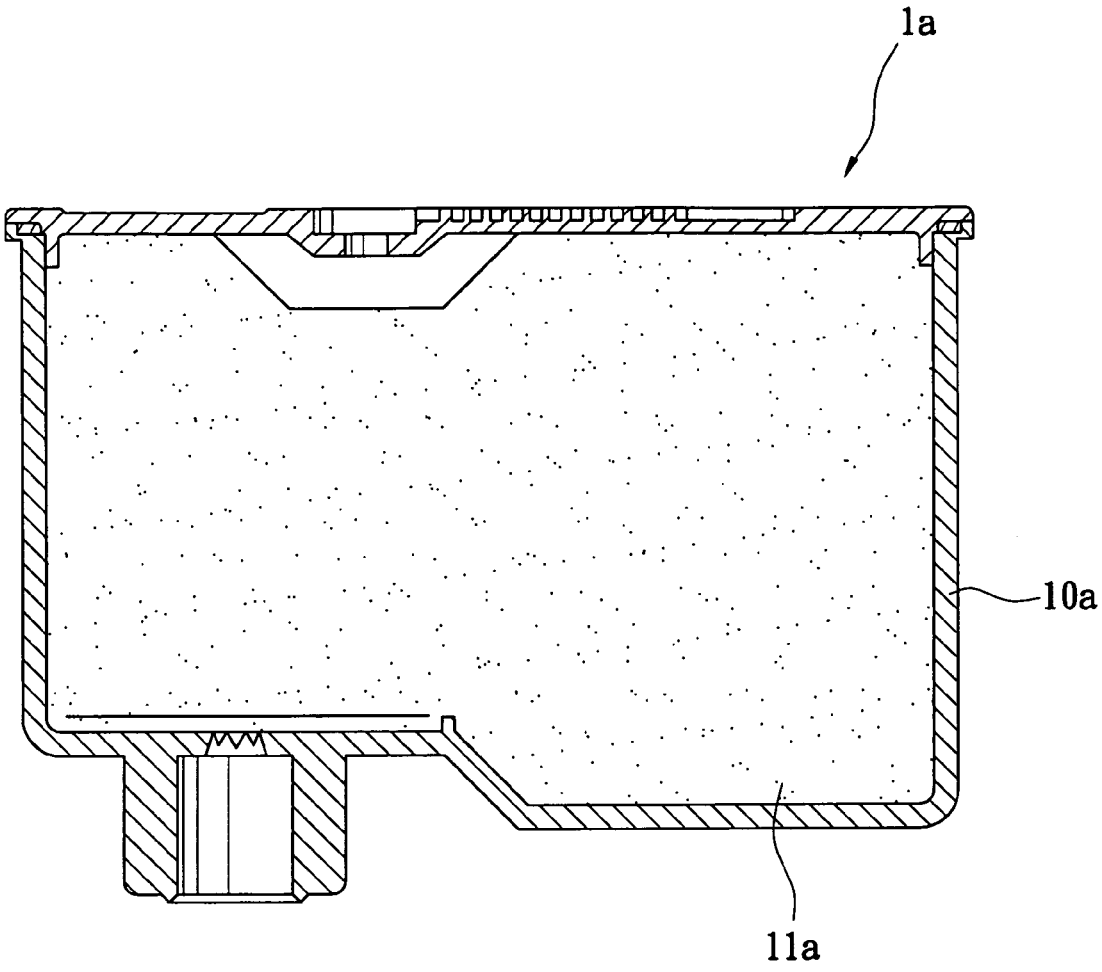
FIG. 1 PRIOR ART
FIG. 1 is a cross-sectional view of an ink cartridge of a prior art.

Wherever possible in the following description, like reference numerals will refer to like elements and parts unless otherwise illustrated.

Figure 2:
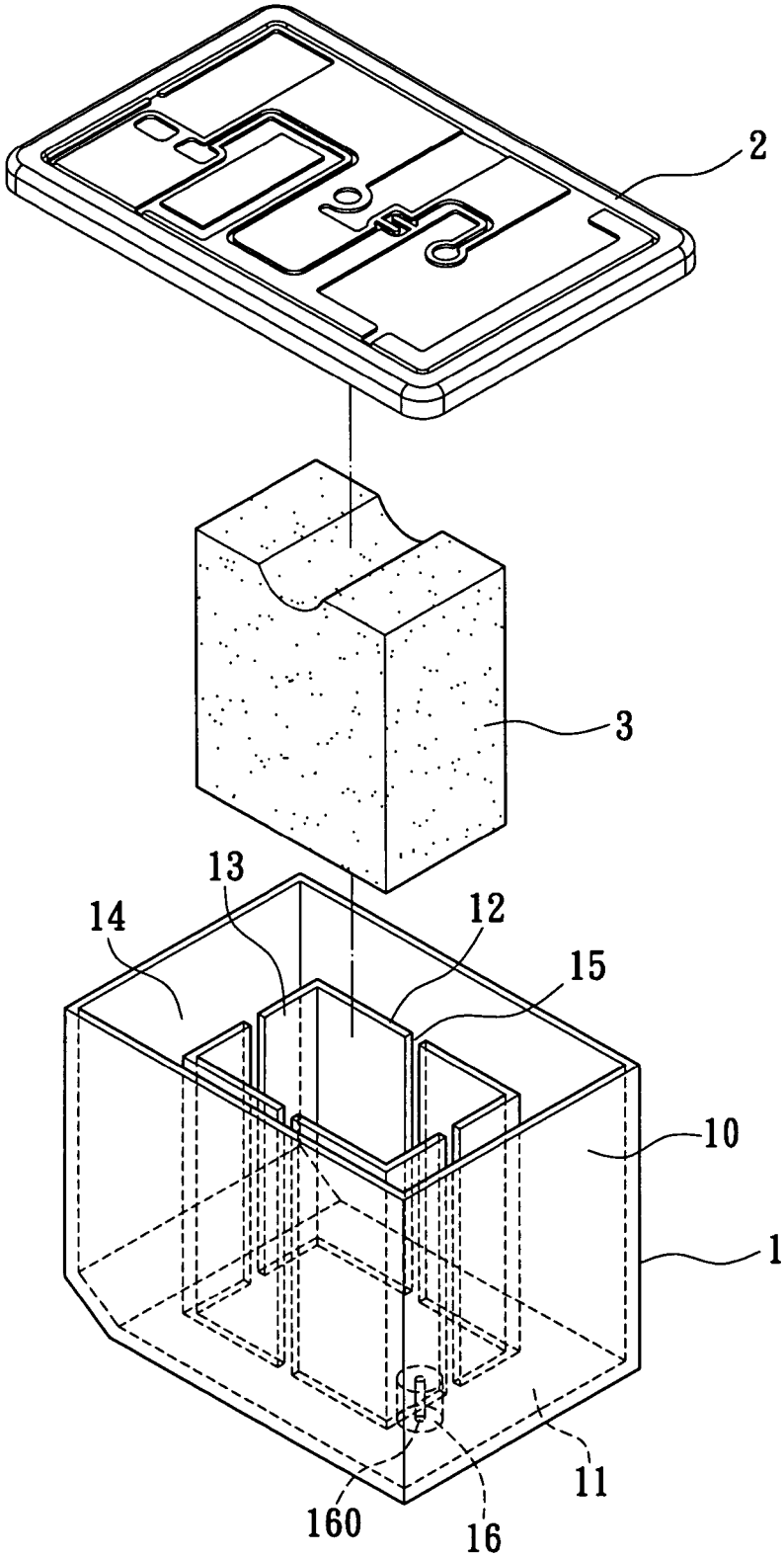
FIG. 2 is an exploded perspective view of the ink cartridge of the present invention.
Figure 3:
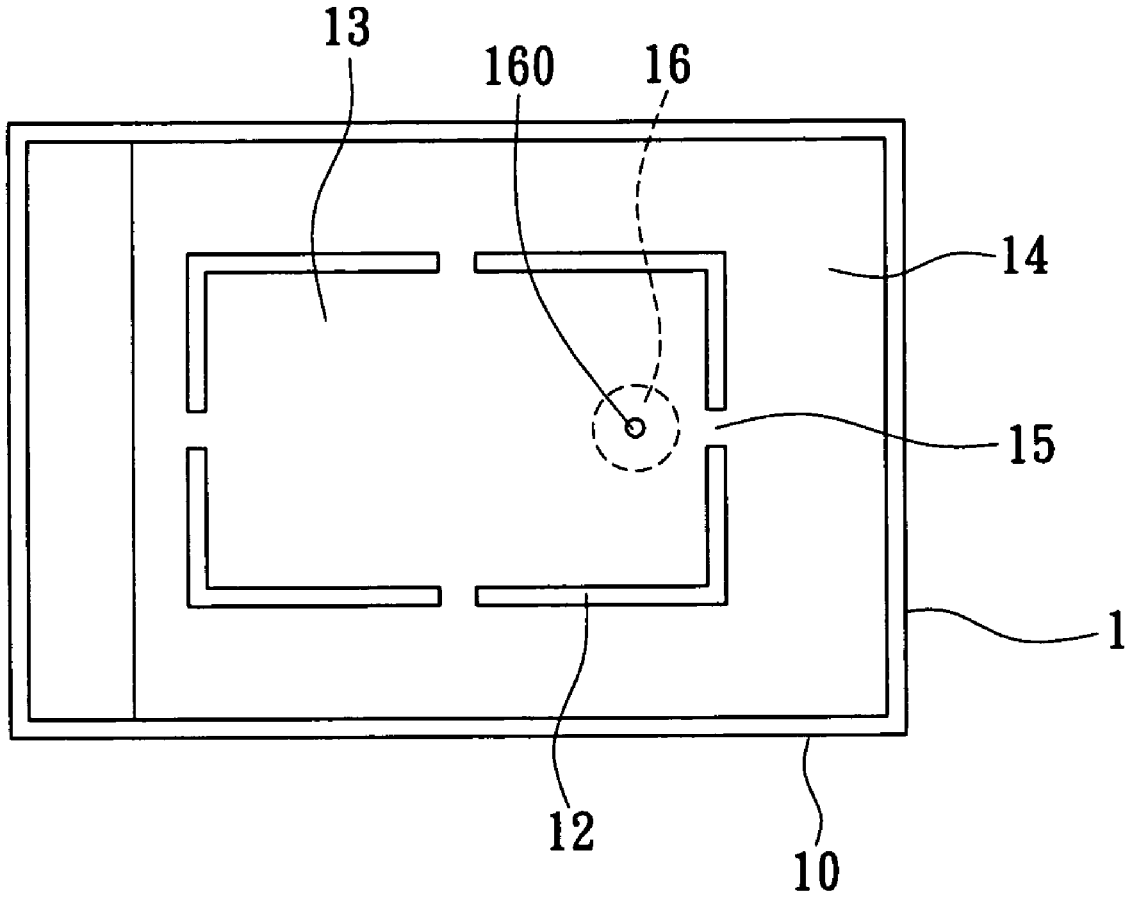
FIG. 3 is a top view of a housing of the ink cartridge of the present invention.
Figure 4:
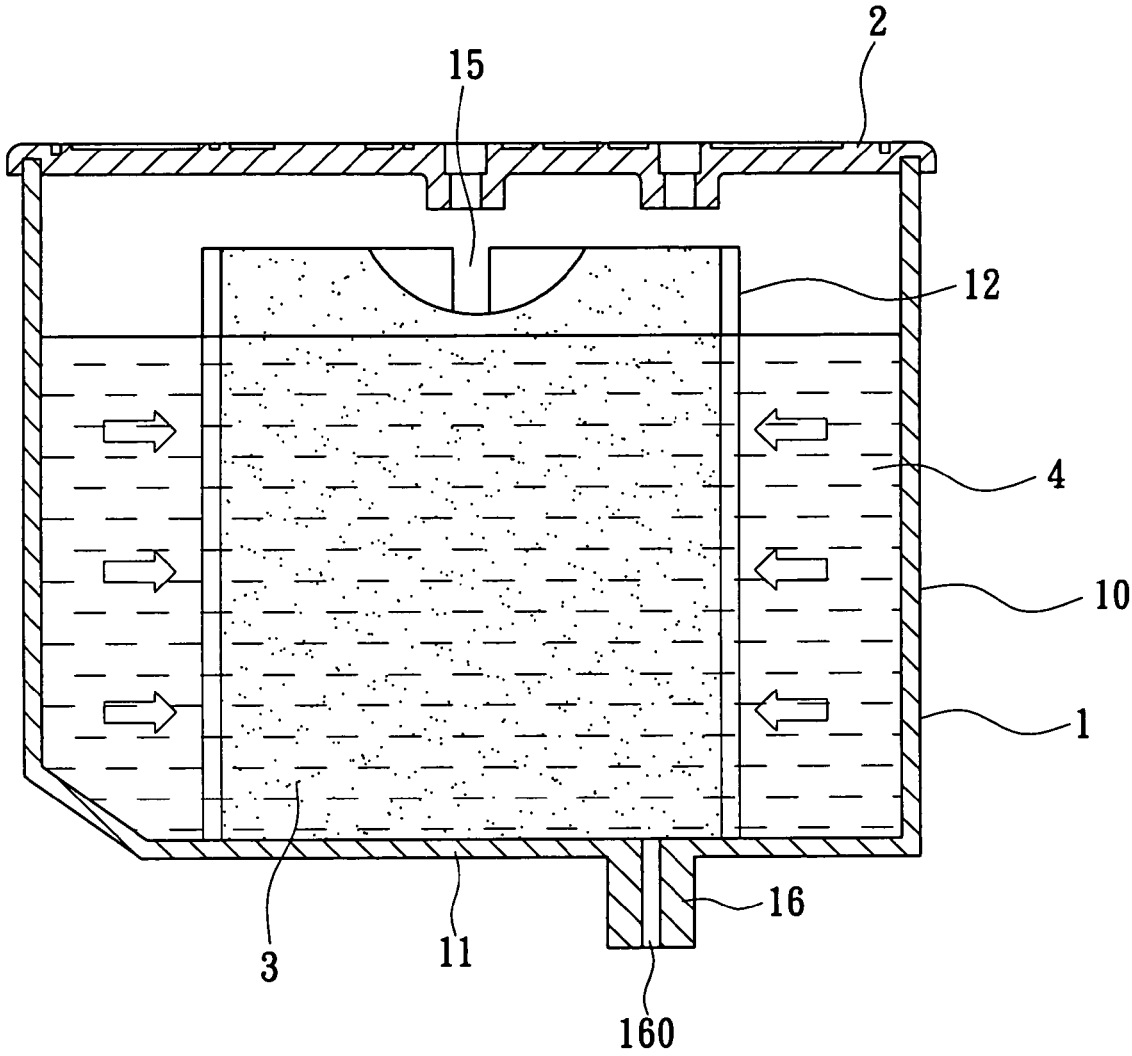
FIG. 4 is a cross-sectional view of the ink cartridge of the present invention showing the ink-flowing condition between two chambers.

With reference to FIGS. 2 to 4, an ink cartridge adapted for an ink jet printer with an ink supply needle (not shown) in accordance with the present invention includes a housing 1, a top cover 2 and an ink porous member 3.

The housing, indicated generally as 1, is integrally formed into a box having an opening on its top. The housing 1 is made of a resin material that suppresses evaporation of ink and is constructed to allow air passage. The housing 1 includes a bottom wall 11 defining as a substantial plane, at least four upstanding side walls 10 extending from edges of the bottom wall 11, four upstanding baffles 12 extending from a middle of the bottom wall 11 to define an inner chamber 13 and an outer chamber 14 around the inner chamber 13. The housing 1 further includes an ink outlet port 16 in communication with the inner chamber 13.

The upper opening of the housing 1 is covered integrally with a top cover 2 having both an ink charging port and an air vent sealed by a sheet member (not shown) designed to permit air flow into the housing 1 while preventing ink loss. The air vent communicates with atmosphere through an air communication passage and an air communication hole. The air communication hole is previously sealed before the ink cartridge is used to avoid leaking ink.

The ink supply needle is positioned relative to the ink cartridge by a positioning member (not shown) which is dimensioned to receive the ink outlet port 16. The ink outlet port 16 is protruded outwardly from an outer surface of the bottom wall 11 of the housing 1. The ink outlet port 16 has an upper opening near an inner surface of the bottom wall of the housing 1 and a lower opening 160 located at an external of the housing 1. Further, the upper opening has a diameter substantially equal to that of the lower opening 160 of the ink outlet port.

The ink porous member 3, formed of a flexible porous material, is disposed within the inner chamber 13 of the housing 1 for being impregnated with ink 4, and the ink 4 also can be filled in the outer chamber 14 thereby to storage with a higher quantity of ink. In various embodiments, the baffle 12 can have a height substantially equal to or smaller than that of the side wall 10. The ink porous member 3 can be dimensioned substantially the same as or smaller than the inner chamber 13 of the housing 1 for reducing the material used in the porous member 3, so that the cost of manufacturing and/or recycling the cartridge can be lower.

As is shown in FIG. 4, at least four slots 15 each are straightly aligned and formed between two abutting baffles 12, so that the ink 4 in the outer chamber 14 can freely flow into the inner chamber 13 through the slots 15. When attaching the ink cartridge to the recording head, the housing 1 is coupled with the recording head in such a manner so as to align the ink outlet port 16 with the ink supply needle. The ink supply needle is inserted into the opening 160 of the ink outlet port 16 for delivering the ink 4 from the inner chamber 13 of the housing 1.

There has thus been described a new, novel and heretofore unobvious ink cartridge which eliminates the aforesaid problem in the prior art. Furthermore, those skilled in the art will readily appreciate that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. An ink cartridge adapted for an ink jet printer, comprising:

a housing having a bottom wall, a plurality of upstanding side walls extending from edges of the bottom wall, a plurality of upstanding baffles extending from a middle of the bottom wall to define an inner chamber and an outer chamber around the inner chamber, and an ink outlet port in communication with the inner chamber for containing ink therein;

a top cover coupled on the housing; and an ink porous member arranged within the inner chamber of the housing for being impregnated with the ink;

wherein at least one slot is formed between at least two abutting baffles, so that the ink in the outer chamber can freely flow into the inner chamber through the slot.

2. The ink cartridge of claim 1, wherein each baffle has a height substantially equal to that of each side wall.

3. The ink cartridge of claim 1, wherein each baffle has a height substantially smaller than that of each side wall.

4. The ink cartridge of claim 1, wherein the ink outlet port is protruded outwardly from an outer surface of the bottom wall of the housing, and the ink outlet port has an upper opening near an inner surface of the bottom wall of the housing and a lower opening located at an external of the housing.

5. The ink cartridge of claim 4, wherein the upper opening has a diameter substantially equal to that of the lower opening of the ink outlet port.

6. The ink cartridge of claim 4, wherein the inner surface of the bottom wall is defined as a substantial plane.

7. The ink cartridge of claim 1, wherein the ink porous member is dimensioned substantially the same as the inner chamber of the housing.

8. The ink cartridge of claim 1, wherein the ink porous member is dimensioned substantially smaller than the inner chamber of the housing.

9. An ink cartridge adapted for an ink jet printer, comprising:

a housing having a bottom wall, four upstanding side walls extending from edges of the bottom wall, four upstanding baffles extending from a middle of the bottom wall to define an inner chamber and an outer chamber and an ink outlet port in communication with the inner chamber for containing ink therein;

a top cover coupled on the housing; and an ink porous member arranged within the inner chamber of the housing for being impregnated with ink, and the ink porous member dimensioned substantially the same as the inner chamber of the housing;

wherein at least four slots each is formed between two abutting baffles, so that the ink in the outer chamber can freely flow into the inner chamber through the slots.

* * * * *